US010767523B2

(12) United States Patent
Shepherd et al.

(10) Patent No.: US 10,767,523 B2
(45) Date of Patent: Sep. 8, 2020

(54) AUXILIARY DRIVE SYSTEM FOR A PUMP

(71) Applicant: Concentric Birmingham Limited, Birmingham (GB)

(72) Inventors: Paul Shepherd, Birmingham (GB); John Magee, Pacifica, CA (US)

(73) Assignee: Concentric Birmingham Limited, Birmingham (GB)

( * ) Notice: Subject to any disclaimer, the term of this patent is extended or adjusted under 35 U.S.C. 154(b) by 0 days.

(21) Appl. No.: 16/534,001

(22) Filed: Aug. 7, 2019

(65) Prior Publication Data

US 2019/0360370 A1 Nov. 28, 2019

Related U.S. Application Data

(63) Continuation of application No. 15/851,817, filed on Dec. 22, 2017, now Pat. No. 10,422,257.

(30) Foreign Application Priority Data

Dec. 22, 2016 (GB) ..... 1621934.7

(51) Int. Cl.
*F01M 1/02* (2006.01)
*F01M 1/18* (2006.01)

(52) U.S. Cl.
CPC ..... *F01M 1/02* (2013.01); *F01M 1/18* (2013.01); *F01M 2001/0223* (2013.01); *F01M 2001/0253* (2013.01)

(58) Field of Classification Search
CPC .... F01M 1/02; F01M 2001/0253; F01M 1/18; F01M 2001/0215; F01M 2001/0223; F01M 2001/0269
See application file for complete search history.

(56) References Cited

U.S. PATENT DOCUMENTS

| | | | | |
|---|---|---|---|---|
| 6,413,183 | B1 | 7/2002 | Ishikawa et al. | |
| 6,425,838 | B1 | 7/2002 | Matsubara et al. | |
| 6,770,005 | B2 | 8/2004 | Aikawa et al. | |
| 7,162,870 | B1 * | 1/2007 | Hauser | B60K 17/105 60/484 |
| 7,347,047 | B1 * | 3/2008 | Hauser | B60K 17/105 60/484 |
| 2002/0000353 | A1 * | 1/2002 | Katou | F16H 57/0482 192/70.12 |
| 2003/0127262 | A1 * | 7/2003 | Noreikat | B60K 6/442 180/65.23 |
| 2003/0230461 | A1 | 12/2003 | Sakata et al. | |
| 2005/0026733 | A1 | 2/2005 | Yoshioka et al. | |
| 2005/0072397 | A1 | 4/2005 | Sluka et al. | |
| 2005/0187066 | A1 | 8/2005 | Moses et al. | |

(Continued)

FOREIGN PATENT DOCUMENTS

| | | | |
|---|---|---|---|
| DE | 102011016558 | A1 | 10/2012 |
| FR | 3029464 | A1 | 6/2016 |

(Continued)

*Primary Examiner* — Long T Tran
(74) *Attorney, Agent, or Firm* — Hogdson Russ LLP

(57) ABSTRACT

A vehicle engine pump assembly (100, 1000, 1100) has a gerotor pump (102), a mechanical drive (106) driven by the engine and an electrical drive (104). A controller (107) selectively engages the mechanical drive to boost pumping effort when required via a clutch.

20 Claims, 9 Drawing Sheets

(56) References Cited

U.S. PATENT DOCUMENTS

| | | | | |
|---|---|---|---|---|
| 2005/0207915 | A1* | 9/2005 | Fledersbacher | F04D 13/022 417/410.1 |
| 2005/0211490 | A1 | 9/2005 | Shimizu et al. | |
| 2008/0173512 | A1* | 7/2008 | Kaneko | F16H 45/02 192/3.29 |
| 2009/0314600 | A1 | 12/2009 | Kato et al. | |
| 2012/0190493 | A1 | 7/2012 | Tamoto | |
| 2013/0112523 | A1 | 5/2013 | Ikegawa | |
| 2013/0149110 | A1* | 6/2013 | Pummell | F16H 57/04 415/122.1 |
| 2013/0151131 | A1 | 6/2013 | Laszlo et al. | |
| 2013/0341151 | A1 | 12/2013 | Ikegawa | |
| 2014/0286801 | A1 | 9/2014 | Böhm | |
| 2015/0184575 | A1* | 7/2015 | Shutty | F01P 7/164 123/41.1 |
| 2017/0167326 | A1* | 6/2017 | Horimatsu | F16H 57/0439 |
| 2017/0276038 | A1* | 9/2017 | Mukohara | B01D 35/005 |

FOREIGN PATENT DOCUMENTS

| | | | |
|---|---|---|---|
| GB | 2273323 | A1 | 6/1994 |
| KR | 101617552 | B1 | 5/2016 |
| WO | 02093042 | A2 | 11/2002 |
| WO | 2013007247 | A1 | 1/2013 |
| WO | 2016146286 | A1 | 9/2016 |

* cited by examiner

AUXILIARY DRIVE SYSTEM FOR A PUMP

CROSS-REFERENCE TO RELATED APPLICATIONS

The present application is a continuation of U.S. application Ser. No. 15/851,817 filed Dec. 22, 2017, which claims priority of British Application No. 1621934.7 filed Dec. 22, 2016, the entire disclosure of which is incorporated herein by reference.

FIELD OF THE INVENTION

The present invention is concerned with an auxiliary drive system for a pump, and a pump having an auxiliary drive system. More specifically, the present invention is concerned with an electrically driven oil pump for a vehicle, the pump having an auxiliary or secondary source of power for use during high demand situations.

BACKGROUND OF THE INVENTION

Internal combustion (IC) engines for vehicles have several moving components which require lubrication. These include rotating shafts, sliding pistons etc. Lubrication occurs by the presence of oil. Oil is usually pumped around the engine by an oil pump. The oil pump will pick up low pressure oil from a sump, and pressurise it before delivery to the engine. Various pressure drops occur as the oil passes through the engine, and the oil eventually returns to the sump for recirculation.

The pumping effort required by the oil pump is determined by many factors. Some factors are inherent in the design of the engine (e.g. clearances and the path through which the oil must pass) and some factors vary through the operating cycle of the engine itself. For example, pumping effort decreases with a decrease in the viscosity of the oil, which in turn decreases as the engine (and oil) warms up. Therefore, it is generally much harder to pump oil around a cold engine because the cold oil has a high viscosity. Once the engine has warmed up, the pump does not have to use as much energy to pump the oil.

Various pump designs are available. Rotary positive displacement pumps such as gear pumps and gerotor pumps are common in this field, and are generally powered a drive connected to a pump input shaft. In some cases, the drive is the engine crankshaft (connected via a belt and pulley). In other cases, the drive is an electric motor.

Electrically driven oil pumps are increasingly common in modern engine design because they offer advanced control. Crankshaft driven pumps are dependent on engine speed, or require a gear train between the crank shaft and pump input shaft. The speed and fluid power output of electrically driven pumps can be varied more easily with electronic control. Electrically driven pumps also have fewer restrictions on placement of the pump (i.e. the input shaft of the pump does not need to be aligned with the crankshaft).

A problem with electrically driven oil pumps is the "cold start" condition. Because of the amount of pumping effort required to drive the cold oil through the engine, the electric motor need to produce a significant amount of torque (and therefore power). The intermittent need to produce a large amount of torque can reduce the life of the motor. Further, the cold start condition represents the "maximum power" design point for the electric motor driving the pump. In other words, the motor needs to be designed for this condition, but for most of the operation of the engine (when it is warm), the motor is not operating anywhere near capacity (i.e. it needs to produce less torque than the maximum power condition). Therefore, a much larger motor is usually provided than is necessary for most of the duty cycle. This increases cost and complexity, and takes up space in the engine.

SUMMARY OF THE INVENTION

It is an aim of the present invention to overcome this problem.

According to a first aspect of the invention there is provided a vehicle engine oil pump assembly comprising:

a pump subassembly having an inlet and an outlet;

an electrical drive arranged to selectively drive the pump subassembly;

a mechanical drive comprising a driven member configured to receive a drive torque from the vehicle engine;

a clutch in a load path between the driven member and the pump subassembly, the clutch being movable between a first condition in which the driven member drives the pump subassembly and a second condition in which the driven member can rotate freely relative to the pump subassembly;

in which the clutch comprises a clutch plate armature defining a friction surface of the clutch and at least partially constructed from a ferromagnetic material, and in which an electromagnet is configured to move the clutch plate armature.

Advantageously, this creates a compact and light arrangement. In one embodiment, the clutch plate armature comprises a ferromagnetic material with a friction material layer. The ferromagnetic material forms part of the magnetic circuit with the electromagnet. Preferably in one of the first and second conditions, the position of the clutch plate armature creates a break in the magnetic circuit, and in the other of the first and second conditions the magnetic circuit is made.

Preferably the clutch is configured to resile to the first condition upon interruption of electrical power to the clutch and/or the electrical drive.

Preferably the clutch is resiliently biased by a spring.

Preferably the clutch comprises a clutch plate armature defining a friction surface of the clutch and at least partially constructed from a ferromagnetic material, and in which the electromagnet is configured to move the clutch plate armature.

Preferably the electromagnet is positioned within the driven member.

Preferably the driven member is at least partially constructed from a ferromagnetic material.

Preferably the driven member comprises an outer driven member and an inner driven member defining an annular volume therebetween, in which the electromagnet is positioned within the annular volume.

Preferably a lubrication flow path is provided such that at least one of the electrical drive and mechanical drive is at least partially lubricated by fluid from the pump outlet in use.

Preferably both the electrical drive and mechanical drive are at least partially lubricated by fluid from the pump outlet in use.

Preferably the electrical drive comprises a rotor and a stator, the rotor is supported on an electrical drive bearing, in which a lubrication flow path is provided from the pump outlet to the electrical drive bearing.

Preferably the electrical drive bearing is a fluid bearing.

Preferably there is provided a sealing structure between the stator and the rotor such that the stator is sealed from the pumped fluid in use.

Preferably the sealing structure comprises a cylindrical structure spanning a radial gap between the stator and the rotor.

Preferably the electric drive rotor is mounted on a common drive shaft with a rotor of the pump subassembly, and in which a return flow path for lubrication flow to the electric drive is provided through the common drive shaft.

Preferably the return flow path for lubrication flow passes through the pump to the mechanical drive.

Preferably the return flow path for lubrication flow returns to the inlet of the pump subassembly from the mechanical drive.

Preferably the common drive shaft extends into the mechanical drive, and in which the lubrication flow from the electrical drive lubricates at least one mechanical drive bearing.

Preferably there is a housing, and a mechanical drive bearing between the housing and the driven member of the mechanical drive, in which a lubrication flow path is provided from the pump outlet to the mechanical drive bearing.

Preferably the mechanical drive bearing is a fluid bearing.

Preferably the electrical drive and the mechanical drive are positioned on opposite sides of the pump subassembly.

According a second aspect of the invention there is provided a vehicle engine pump assembly comprising:

a pump; and, a clutch having a mechanical input and configured to selectively drive the pump;

in which the clutch comprises a clutch plate armature defining a friction surface of the clutch and at least partially constructed from a ferromagnetic material, and in which an electromagnet is configured to move the clutch plate armature.

Preferably the clutch is configured to resile to the first condition upon interruption of electrical power to the clutch and/or the electrical drive.

Preferably there is provided an electrical drive arranged to selectively drive the pump.

Preferably the mechanical input is provided via a driven member, and the electromagnet is positioned within the driven member.

Preferably the driven member is at least partially constructed from a ferromagnetic material.

Preferably the driven member comprises an outer driven member and an inner driven member defining an annular volume therebetween, in which the electromagnet is positioned within the annular volume.

The pump may be a water pump.

According to a third aspect there is provided vehicle engine oil pump assembly comprising:

a pump subassembly having an inlet and an outlet;

an electrical drive arranged to selectively drive the pump subassembly;

a mechanical drive comprising a driven member configured to receive a drive torque from the vehicle engine;

a clutch in a load path between the driven member and the pump subassembly, the clutch being movable between a first condition in which the driven member drives the pump subassembly and a second condition in which the driven member can rotate freely relative to the pump subassembly;

wherein a lubrication flow path is provided such that at least one of the electrical drive and mechanical drive is at least partially lubricated by fluid from the pump outlet in use.

Preferably both the electrical drive and mechanical drive are at least partially lubricated by fluid from the pump outlet in use.

Preferably the electrical drive comprises a rotor and a stator, the rotor is supported on an electrical drive bearing, in which a lubrication flow path is provided from the pump outlet to the electrical drive bearing.

Preferably the electrical drive bearing is a fluid bearing.

Preferably there is provided a sealing structure between the stator and the rotor such that the stator is sealed from the pumped fluid in use.

Preferably the sealing structure comprises a cylindrical structure spanning a radial gap between the stator and the rotor.

Preferably the electric drive rotor is mounted on a common drive shaft with a rotor of the pump subassembly, and in which a return flow path for lubrication flow to the electric drive is provided through the common drive shaft.

Preferably the return flow path for lubrication flow passes through the pump to the mechanical drive.

Preferably the return flow path for lubrication flow returns to the inlet of the pump subassembly from the mechanical drive.

Preferably the common drive shaft extends into the mechanical drive, and in which the lubrication flow from the electrical drive lubricates at least one mechanical drive bearing.

Preferably there is provided a housing, and a mechanical drive bearing between the housing and the driven member of the mechanical drive, in which a lubrication flow path is provided from the pump outlet to the mechanical drive bearing.

Preferably the mechanical drive bearing is a fluid bearing.

Preferably wherein the electrical drive and the mechanical drive are positioned on opposite sides of the pump subassembly.

Preferably the pump assembly comprises a positive displacement pump.

Preferably which the pump assembly comprises a gerotor pump.

Preferably the driven member comprises a pulley.

Preferably the driven member comprises a gear formation.

There is also provided a vehicle engine comprising a vehicle engine oil pump assembly according to any preceding claim.

The invention also provides a method of operation of a vehicle engine oil pump comprising the steps of:

providing a vehicle engine pump according to the above aspects;

providing a controller configured to selectively power the electrical drive and operate the clutch;

receiving an engine parameter with the controller;

using the controller to select mechanical and/or electrical power depending on the received engine parameter.

Preferably the controller is configured to select electrical power below a predetermined pumping demand, and electrical and mechanical power above the predetermined pumping demand.

According to a fourth aspect of the invention there is provided a vehicle engine oil pump assembly comprising:

a pump subassembly having an inlet and an outlet;

an electrical drive arranged to selectively drive the pump subassembly;

a mechanical drive comprising a driven member configured to receive a drive torque from the vehicle engine;

a clutch in a load path between the driven member and the pump subassembly, the clutch being movable between a first condition in which the driven member drives the pump subassembly and a second condition in which the driven member can rotate freely relative to the pump subassembly.

Advantageously, this configuration allows for electrical power to be used most of the time. When extra pumping effort is required (for example during cold start), mechanical power can be engaged via the clutch to assist the electric motor. The mechanical drive can be driven by e.g. the engine crankshaft.

Preferably, a lubrication flow path is provided such that at least one of the electrical drive and mechanical drive is at least partially lubricated by fluid from the pump outlet in use. Preferably both the electrical drive and mechanical drive are at least partially lubricated by fluid from the pump outlet in use. The use of the pumped fluid as lubrication flow provides for simple lubrication in a compact assembly.

The electrical drive generally comprises a rotor and a stator, in which the rotor is supported on an electrical drive bearing, and in which a lubrication flow path is provided from the pump outlet to the electrical drive bearing. Preferably the electrical drive bearing is a fluid bearing which is a hydrostatic bearing. This reduced the cost and complexity associated with e.g. rolling element bearings.

Preferably there is provided a sealing structure between the stator and the rotor such that the stator is sealed from the pumped fluid in use. Preferably the sealing structure comprises a cylindrical "can" structure spanning a radial gap between the stator and the rotor which separates the motor into a "dry side" and a "wet side". Preferably the motor is a brushless DC motor, in which case the rotor (which requires no electrical power) is on the "wet side" and the stator (which requires electrical power) is kept on the dry side—i.e. isolated from the pumped fluid.

Preferably the electric drive rotor is mounted on a common drive shaft with a rotor of the pump subassembly, and in which a return flow path for lubrication flow to the electric drive is provided through the common drive shaft. The use of the shaft as a fluid path allows for a compact arrangement, and minimises drillings and flow paths in the housing.

Preferably the return flow path for lubrication flow passes through the pump to the mechanical drive. More preferably the return flow path for lubrication flow returns to the inlet of the pump subassembly from the mechanical drive. Even more preferably the lubrication flow from the electrical drive lubricates at least one mechanical drive bearing. This makes full use of the pressure of the pumped fluid- to create a lubrication circuit to the electrical drive, through the shaft (past the motor) and to the mechanical drive. This creates a compact and efficient assembly.

The assembly comprises a housing, and a mechanical drive bearing is provided between the housing and the driven member of the mechanical drive. Preferably a lubrication flow path is provided from the pump outlet to the mechanical drive bearing. Preferably the mechanical drive bearing is a fluid bearing, which reduces moving parts and cost compared to a rolling element bearing.

Preferably the electrical drive and the mechanical drive are positioned on opposite sides of the pump subassembly.

Advantageously, placing the pump between the mechanical and electrical drive makes porting for the various lubrication paths more convenient. There is a short path between both drives and the high and low pressure ports of the pump which can be accessed with simple drillings in the housing. This design also places the mechanical and electrical drives at the ends of the assembly, providing easy access without the requirement to take the assembly apart.

The pump has a rotor mounted on a pump shaft which can be selectively driven about a pump axis by the electrical and/or mechanical drive to pump fluid through the pump. Preferably the pump shaft extends in to the mechanical drive and the electrical drive, so they can drive it directly.

Preferably the clutch comprises a clutch plate moveable along the pump axis between the first and second conditions. The clutch may be a flat plate clutch, or preferably a cone clutch which provides a greater surface area.

The clutch may comprise two sub-clutches movable between the first condition and the second condition. Preferably there are two clutch plates which act in opposite directions to balance the axial loads in the assembly and on the shaft to which the clutch is mounted. Preferably the first sub-clutch is a primary clutch, the second sub-clutch is a secondary clutch and the primary clutch is radially outside the secondary clutch.

Preferably the clutch is electrically actuated, and the clutch resiles to the first condition in the absence of electrical power. This is a "failsafe" condition, so if electrical power is not available (in which case the electrical drive would stop), the mechanical drive will engage by default to keep the engine lubricated. Preferably the clutch is resiliently biased by a spring.

Preferably which the clutch is actuated by an electromagnet. More preferably the clutch comprises a clutch plate armature defining a friction surface of the clutch and at least partially constructed from a ferromagnetic material, and in which the electromagnet is configured to move the clutch plate armature. Combining the armature and the clutch offers a compact design.

Preferably the electromagnet is positioned within the driven member, which is a highly compact arrangement. Preferably the driven member is at least partially constructed from a ferromagnetic material, therefore proving dual function by acting as a magnetic field path.

Preferably the driven member comprises an outer driven member and an inner driven member defining an annular volume therebetween, in which the electromagnet is positioned within the annular volume.

Preferably an electronic control board is mounted to the electrical drive. More preferably the electronic control board is mounted proximate a first surface of housing of the electrical drive, and in which a fluid path from the outlet passes against a second surface of the housing within the electrical drive such that pumped fluid cools the first surface in use.

Preferably the pump assembly comprises a positive displacement pump, more preferably a gerotor pump.

The driven member may comprises a pulley or gear driven by the engine crankshaft.

The invention also comprises a vehicle engine having a vehicle engine oil pump assembly according to the first aspect.

According to a fifth aspect of the invention there is provided a method of operation of a vehicle engine oil pump comprising the steps of:

providing a vehicle engine oil pump according to the first aspect;

providing a controller configured to selectively power the electrical drive and operate the clutch;

receiving an engine parameter with the controller;

using the controller to select mechanical and/or electrical power depending on the received engine parameter.

Preferably the controller is configured to select electrical power below a predetermined pumping demand, and electrical and mechanical power above the predetermined pumping demand.

BRIEF DESCRIPTION OF THE DRAWING VIEWS

Various example pump drive systems in accordance with the present invention will now be described with reference to the accompanying Figures, in which.

DETAILED DESCRIPTION OF THE INVENTION

The First Embodiment—Configuration

Figure 1:
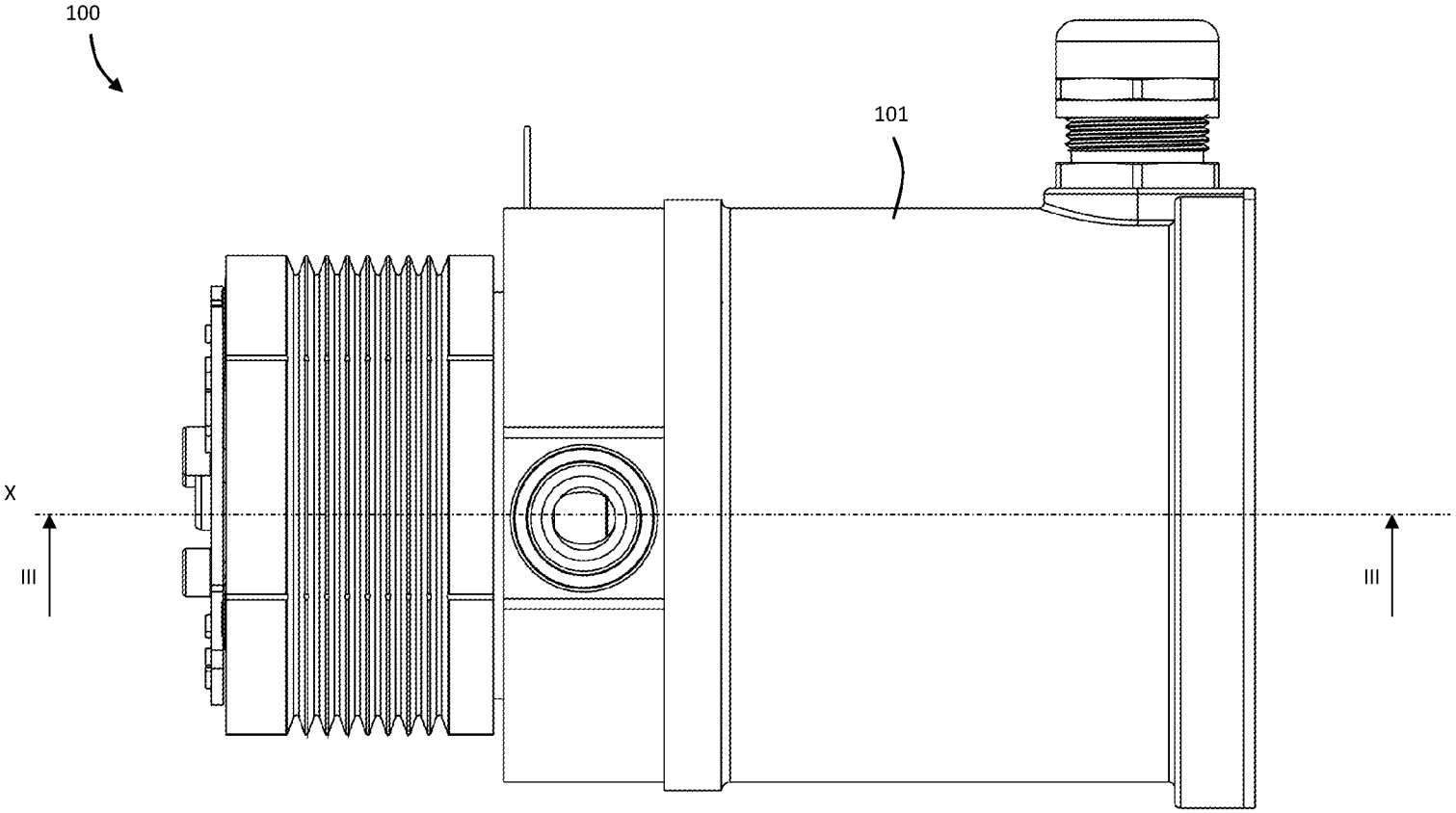
FIG. 1 is a perspective view of a pump having a first drive system in accordance with the invention.
Figure 2:
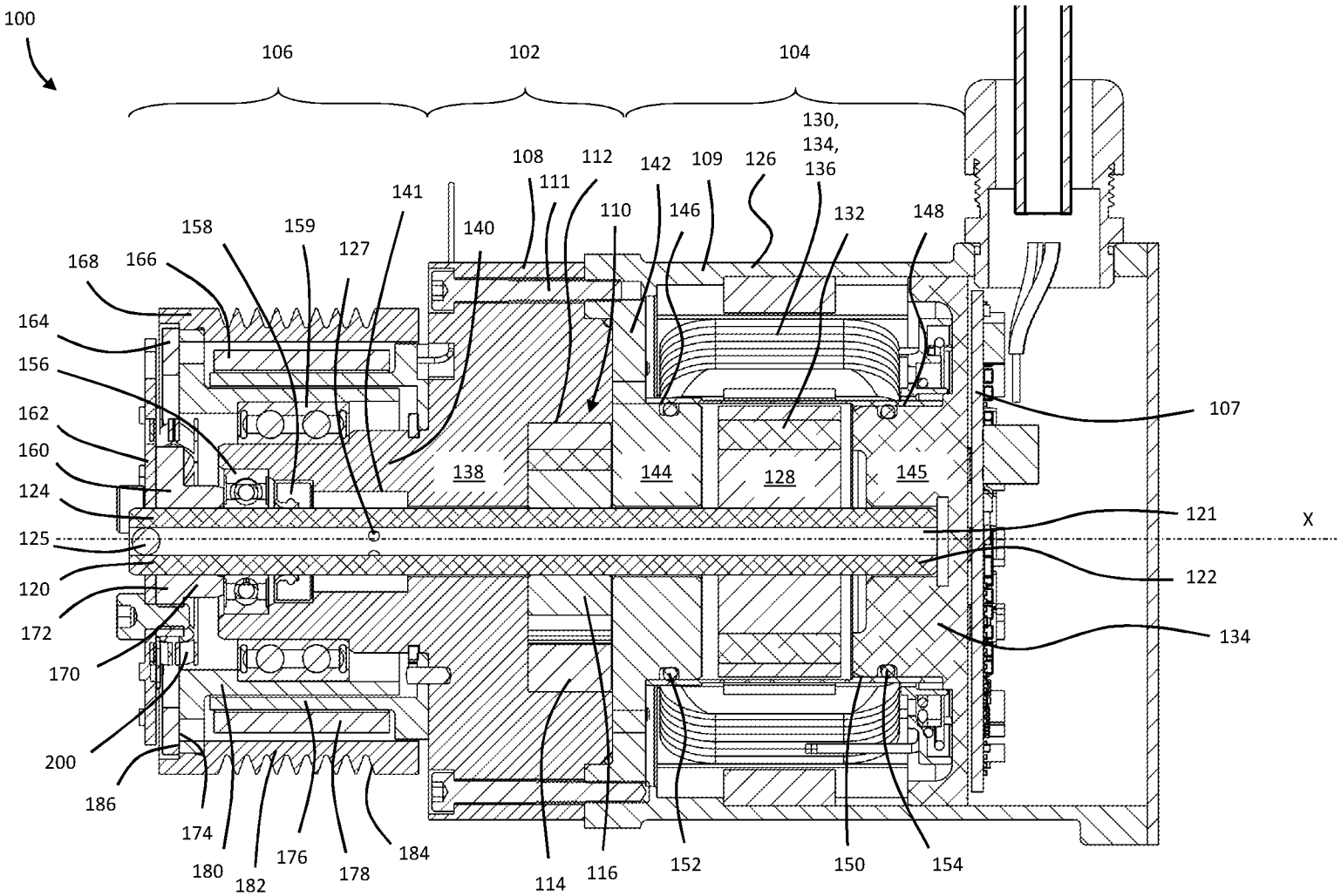
FIG. 2 is a section view of the pump of FIG. 1 taken in the plane of FIG. 1.
Figure 3:
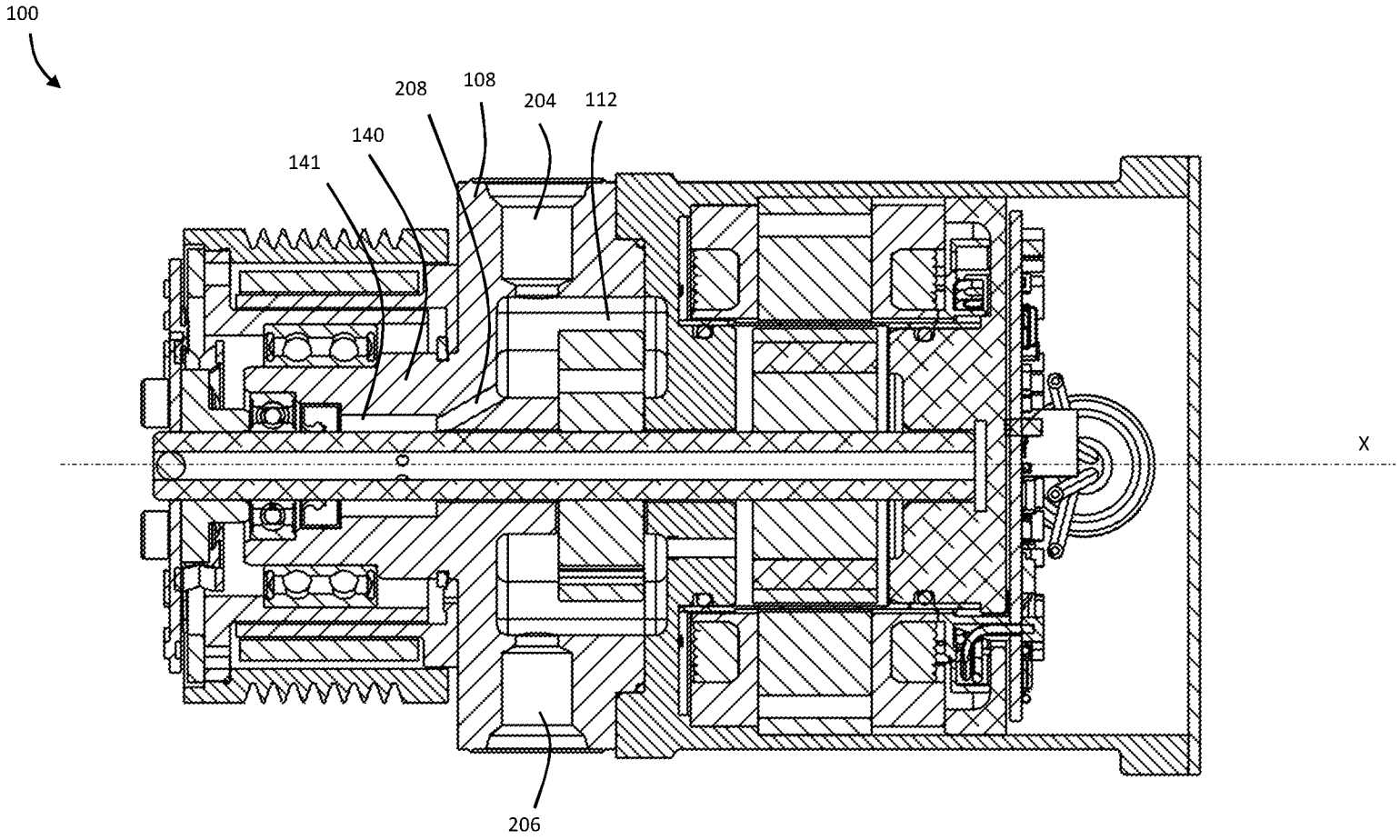
FIG. 3 is a section view of the pump of FIG. 1 taken along line III-III in FIG. 1.

Referring to FIGS. 1 to 3, there is shown an oil pump assembly 100. The pump assembly 100 generally comprises a housing 101, a pump 102, an electric drive 104, a mechanical drive 106 and a control board 107. The pump assembly defines a main axis X.

The housing 101 comprises a first housing part 108, a second housing part 109 and an end part 134. The first housing part 108 comprises a pump housing portion 138 defining a rotor cavity 112 eccentric with respect to the main axis X. The pump cavity 112 is in fluid communication with an oil inlet 204 and an oil outlet 206. The oil inlet 204 is configured to receive low pressure oil and to deliver it to both axial sides of the rotor cavity 112 at a first circumferential position. As well as being fed low pressure oil from the engine, the oil inlet is also in fluid communication with a return channel 208. The first housing part 108 further defines an annular first housing extension 140 projecting axially opposite to the rotor cavity 112. The first housing extension 140 has a central shaft bore 141 which is in fluid communication with the return channel 208.

The second housing part 109 defines an annular pump sealing flange 142 having a housing extension 126 extending axially proximate its outer rim. The second housing part further defines an annular second housing extension 144 projecting from its hub, having a radially outwardly facing shoulder 146.

The end part 134 is generally circular having an annular end extension 145 extending proximate its hub defining a radially outwardly facing shoulder 148.

The first and second housing parts 108, 109 are fastened together with a series of mechanical fasteners 111.

The pump 102 comprises a rotor assembly 110. The rotor assembly 110 comprises an outer rotor 114 and an inner rotor 116. The outer rotor 114 is generally annular having a cylindrical radial outer surface and a radial inner surface having N+1 radially projecting lobes formed thereon. The outer surface of the outer rotor 114 is engaged with the rotor cavity for rotation about an axis offset from X. The inner rotor 116 has a radial outer surface having N radially extending lobes engaged with the recesses between the lobes of the outer rotor. The rotor assembly 110 is positioned within the rotor cavity 112 of the first housing part 108 and enclosed by the second housing part 109.

Rotation of the inner rotor 116 about the axis X rotates the outer rotor 114 and acts to create a pumping effect. As such, the rotor assembly is that of a gerotor pump, which can pump fluid from a first circumferential position of the rotor cavity (where the oil inlet is located) to a second circumferential position (where the oil outlet is located). The general operation of gerotor pumps is well understood in the art and will not be described further here.

The inner rotor 116 is driven by a pump input shaft 120 mounted for rotation about axis X. The pump input shaft 120 extends either side of the inner rotor 116 to define a first shaft extension 122 and a second shaft extension 124, on the opposite side of the pump 102 to the first shaft extension 122. The shaft 120 defines a central axial fluid channel 121, which is sealed at the end of the second shaft extension 124 by a seal 125. The second shaft extension 124 defines a plurality of axially extending openings 127 which place the channel 121 in fluid communication with the central shaft bore 141, thus facilitating a return flow via return channel 208 to the low pressure inlet 204 of the pump 102.

The first shaft extension 122 is engaged in a plain bearing with the second housing part 109, and the second shaft extension 124 is engaged in a plain bearing with the first housing part 108. As such, as the pump 120 pressurises the oil in the cavity 112, there is provided a hydrodynamic lubricating flow between the shaft 120 and the housing part 109. This is discussed further below.

Turning to the electric drive 104, this is disposed within the extension 126 of the second housing part 109 of the pump assembly 100. The electric drive comprises a rotor 128 attached to the first shaft extension 122 and a stator 130 surrounding the rotor 128. The rotor 128 comprises a plurality of circumferentially spaced permanent magnets 132. The stator 130 comprises a plurality of electromagnets 134 comprising coils 136 which are attached to the interior surface of the second housing extension 126. The rotor 128 and stator 130 together form a brushless DC motor (BLDC) capable of driving the shaft 120 in rotation upon application of DC electrical power.

A can 150 is positioned between the rotor 128 and stator 130. The can 150 is a cylindrical component which is sealed against the spaced apart shoulders 146, 148 of the second housing part 109 and end part 134 respectively with o-ring seals 152, 154. The can 150 provides a seal between the "wet" rotor and "dry" stator. As discussed above, there a lubricating oil flow from the pump 110 enters the electric drive 104 along the shaft 120, and the presence of the can prevents the oil from contacting the stator 130.

The shaft extension 122 is engaged via a plain bearing in the extension 145 of the housing end part 134.

Turning to the mechanical drive 106, there is provided a shaft bearing 156, a shaft seal 158, a pulley bearing 159, a clutch plate boss 160, a clutch plate mount 162, a clutch plate armature 164, a solenoid 166 and a pulley 168.

The shaft seal 158 sits within the first housing extension 140 and bears against the outer periphery of the shaft 120 (in particular the shaft extension 122). The shaft bearing 156 facilitates rotation of the shaft 120 within the first housing extension 140. The shaft bearing 156 is a ball bearing and therefore configured to react any radial load applied to the shaft 120.

The clutch plate boss 160 comprises a shaft portion 170 and a flange 172. The shaft portion 170 is splined to the shaft 120 for rotation therewith. The boss 160 can therefore slide on the shaft 120 along the axis X. The clutch plate mount 162 is an annular disc which is attached to the flange of the clutch plate boss for rotation therewith. The clutch plate armature 164 is an annular component attached to the clutch plate mount 162. The clutch plate armature 164 is constructed from a ferrous material and has an annular friction surface 174. A clutch spring 200 is provided to resiliently urge the clutch plate armature away from the pulley 168.

The solenoid 166 comprises a solenoid mount 176 and an electromagnet 178 comprising a coil which can be selectively charged to produce a magnetic field. The solenoid mount 176 is positioned on the radially inner surface of the electromagnet 178, leaving the radially outer surface of the electromagnet 178 exposed. The solenoid 166 is attached to the first housing part 108 and is static relative thereto.

The pulley 168 comprises a pulley inner 180 and a pulley outer 182. The pulley inner 180 comprises a hollow shaft which is mounted for rotation about the first housing extension 140 of the first housing part 108 on the pulley bearing 159. The pulley bearing 159 is a double angular contact ball bearing arrangement which is configured to resist axial loads between the first housing part 108 and the pulley 168.

The pulley outer 182 is attached to the pulley inner 180 for rotation therewith via a press fit (although it is possible to construct them as a unitary component). The pulley outer 182 defines a series of external grooves 184 configured to receive a toothed belt (driven by a crankshaft). The pulley outer 182 is constructed from a ferrous material, and in conjunction with the solenoid mount 176 sandwiches the electromagnet there between.

The pulley inner 180 defines an axially facing clutch surface 186 which faces the clutch plate armature 164.

The control board 107 is mounted to the end of the housing end part 134. The control board is a circular board on which control electronics for the pump assembly 100 are mounted. The solenoid 166 is operated like an additional phase from the motor controller via the vehicle CAN bus from an engine control unit (ECU). Upon receipt of a command from the ECU, the control board can selectively provide power to the electromagnet 134 and/or the electromagnet 178 as will be discussed below.

The First Embodiment—Use

The pump assembly 100 has three main modes, which will be described below.

(i) Electric Only Mode

In this mode, the control board 107 receives a pump demand signal from the ECU and provides power to the electromagnets 134 to drive the motor and thereby pump oil through the pump 102. The input power may be varied to provide the desired pumping effort.

(ii) Mechanical Only Mode

In this mode, the control board 107 receives a demand which exceeds a predetermined pumping power available from the motor 102 alone. The electromagnets 134 are not energised, and instead the electromagnet 178 in the solenoid 166 is energised. The resulting magnetic field draws the clutch plate armature 164 into contact with the axial end of the pulley inner 180. This forms a load path from the pulley 168, through the clutch plate armature 164, through the clutch plate mount 162 to the clutch plate boss 160 and to the shaft 120 to power the pump 102. In this way, the pump 102 can be driven by the engine crankshaft.

(iii) Hybrid Mode

In this mode, the electric drive 104 and mechanical drive 106 are simultaneously activated by the control board 107 to provide extra power to the pump 102.

It will be noted that as the pump 102 pressurises the oil therein, there is provided a hydrodynamic lubricating flow between the shaft 120 and the housing part 109. This lubricates the plain bearing between the shaft 120 and the second housing part 109. The oil passes through the "wet" rotor in the electric drive 104 and to the plain bearing between the shaft 120 and the housing end part 134.

The oil then passes into the end of the shaft 120 and enters the central channel 121 under pressure. As the oil passes into the axial end of the shaft extension 122 within the end part 134, it also cools the adjacent control board 107. The lubricating flow then proceeds through the channel 121, back past the pump 102 and to the mechanical drive 106. As the channel 121 is sealed by the seal 125, the oil escapes through the openings 127. The oil cannot pass the shaft seal 158 and passes though the plain bearing between the shaft extension 121 and first housing extension 140 back to the low pressure pump inlet.

The ability to flood the motor rotor is beneficial for lubrication and cooling and permits use of plain, fluid lubricated bearings which offers excellent radial load reaction as well as long life and reliability.

The Second Embodiment—Configuration

Figure 4:
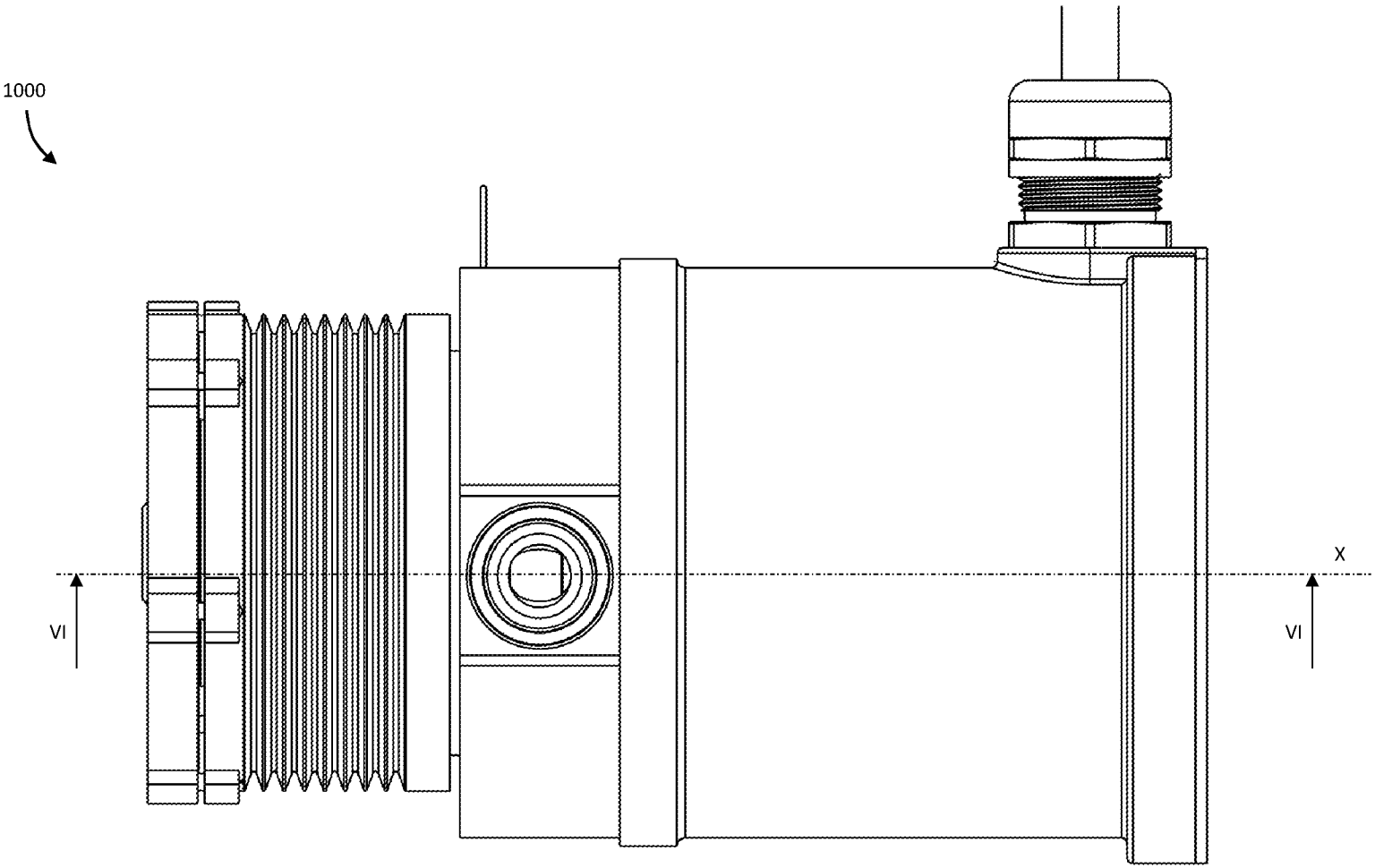
FIG. 4 is a perspective section view of a pump having a second drive system in accordance with the invention.
Figure 5:
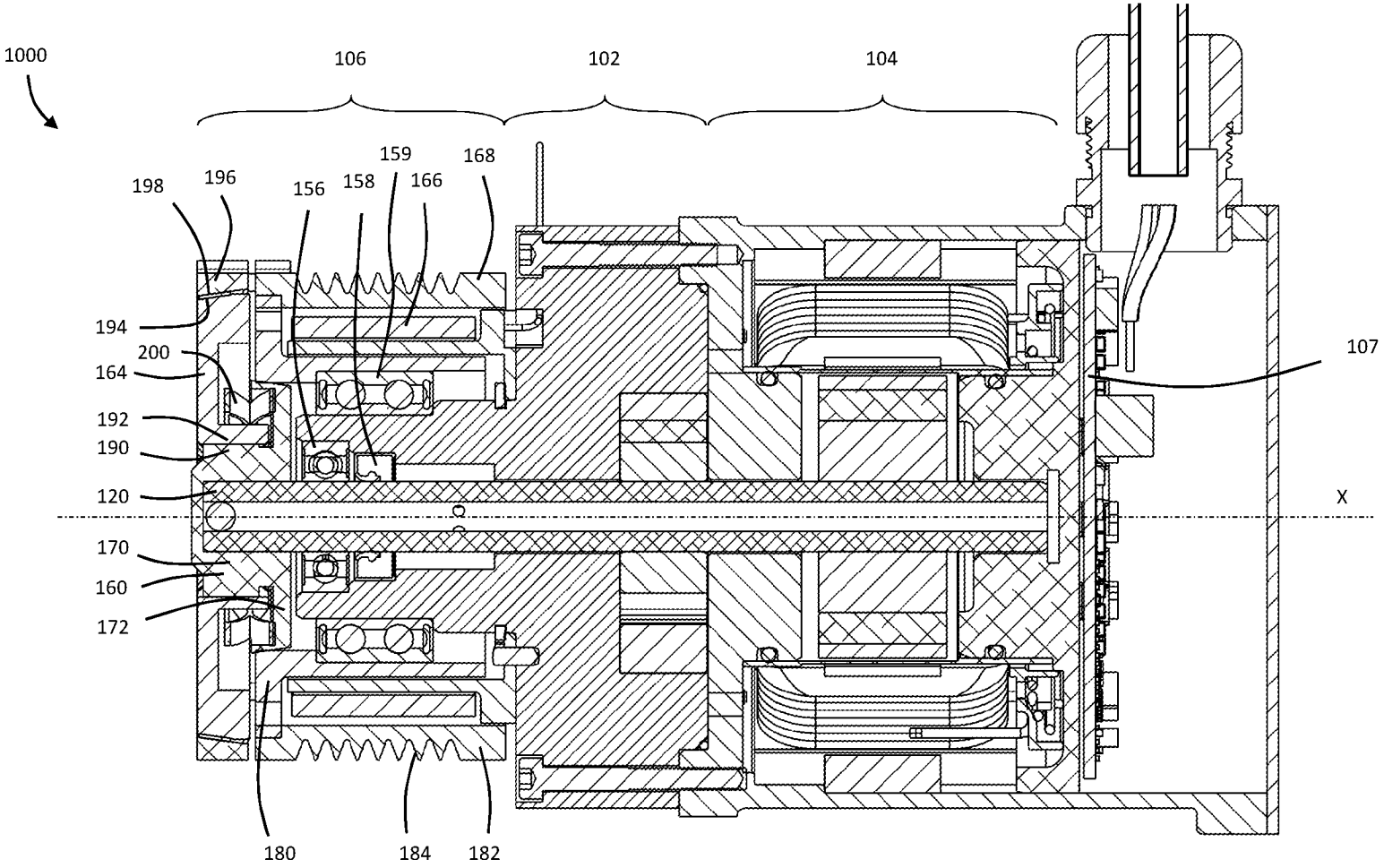
FIG. 5 is a section view of the pump of FIG. 4 taken in the plane of FIG. 4.
Figure 6:
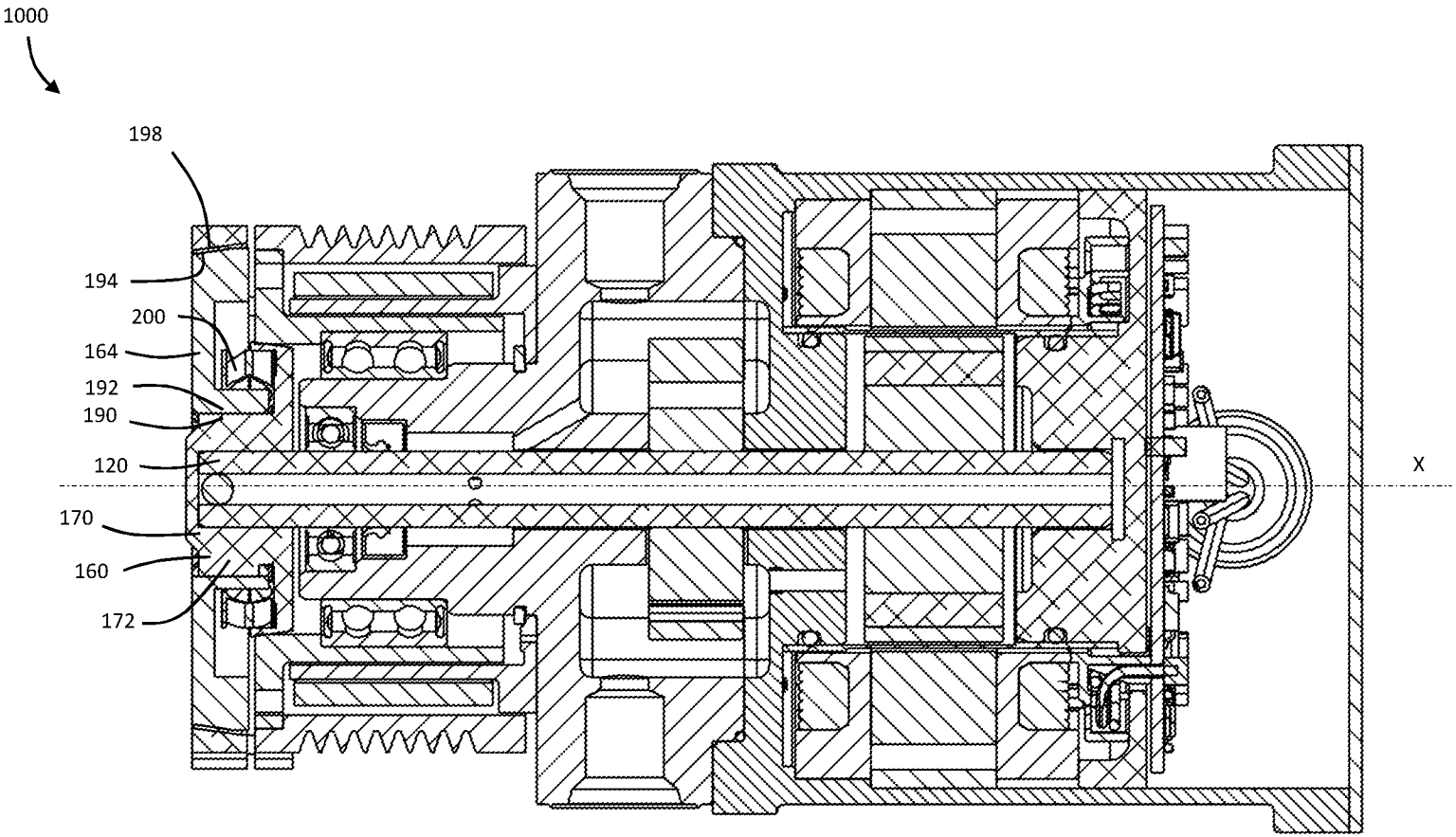
FIG. 6 is a section view of the pump of FIG. 1 taken along line VI-VI in FIG. 4.

Referring to FIGS. 4 to 6, a second embodiment of a pump assembly 1000 is shown. Reference numerals used are common with those in the first embodiment.

As with the first embodiment, the pump assembly comprises a housing 101, a pump 102, an electric drive 104, a mechanical drive 106 and a control board 107. The pump assembly defines a main axis X.

The housing 101, pump 102, electric drive 104 and control board 107 are physically identical to those in the first embodiment. The mechanical drive 106 differs, as will be described below.

The mechanical drive 106 comprises a shaft bearing 156, a shaft seal 158, a pulley bearing 159, a clutch plate boss 160, a clutch cone armature 164, a solenoid 166 and a pulley 168.

The shaft bearing 156, shaft seal 158, pulley bearing 159 and solenoid 166 are substantially identical to those of the first embodiment.

The clutch plate boss 160 comprises a shaft portion 170 and a flange 172. The shaft portion 170 is keyed to the shaft 120 for rotation therewith. The shaft portion 170 defines an external spline 190 onto which the clutch cone armature 164 is mounted via a corresponding female spline 192. The clutch cone armature 164 is therefore fixed for rotation with the boss 160 but can slide relative thereto along the axis X.

The clutch cone armature 164 is constructed from a ferrous material and defines an external conical friction surface 194 which tapers radially outwardly towards the pump assembly 1000. The clutch cone is biased in an axial sense by a clutch spring 200. The clutch spring 200 is a compression spring which bears against the flange 172 of the clutch plate boss 160 and the clutch cone armature 164.

The pulley 168 comprises a pulley inner 180, a pulley outer 182 and a pulley clutch collar 196. The pulley inner 180 is identical to that of the first embodiment. The pulley outer 182 is attached to the pulley inner 180 for rotation therewith. The pulley outer 182 defines a series of external grooves 184 configured to receive a toothed belt (driven by a crankshaft). The pulley outer 182 is constructed from a ferrous material, and in conjunction with the solenoid mount 176 sandwiches the electromagnet therebetween.

The pulley clutch collar 196 is an annular component which is attached to the pulley outer 182 by mechanical fasteners. The collar 196 has a conical radially inner friction surface 198 which is configured to receive the external conical surface of the clutch cone armature 164. The clutch spring 200 biases the clutch cone armature into engagement with the pulley clutch collar 196.

The Second Embodiment—Use

The second embodiment of the pump assembly 1000 has three main modes, which will be described below.

(i) Electric Only Mode

In this mode, the control board 107 receives a pump demand signal from the ECU and provides power to the electromagnets 134 to drive the motor and thereby pump oil through the pump 102. For electric-only operation, the solenoid 166 is energised, which draws the clutch cone armature 164 towards it. This compresses the clutch spring 200 and disengages the clutch cone armature from the pulley clutch collar 196. In this manner, the load path between the pulley 168 and the shaft 120 is broken.

The input power to the electric drive 102 may be varied to provide the desired pumping effort.

(ii) Mechanical Only Mode

In this mode, the control board 107 receives a demand which exceeds a predetermined pumping power available from the motor 102 alone. The electromagnets 134 are not energised, and instead the electromagnet 178 in the solenoid 166 is de-energised. The action of the spring 200 pushes the clutch cone armature 164 into engagement with the collar 196 which forms a load path from the pulley 168 to the shaft 120 to power the pump 102. In this way, the pump 102 can be driven by the engine crankshaft.

(iii) Hybrid Mode

In this mode, the electric drive 104 and mechanical drive 106 are simultaneously engaged by the control board 107 to provide extra power to the pump 102. It will be noted that to engage the mechanical drive, the solenoid 166 needs to be de-energised.

This embodiment provides a "failsafe" condition should electrical power be interrupted. A complete loss of electrical power to the assembly 1000 will result in the mechanical drive 106 being activated with the electric drive dormant.

The Third Embodiment—Configuration

Figure 7:
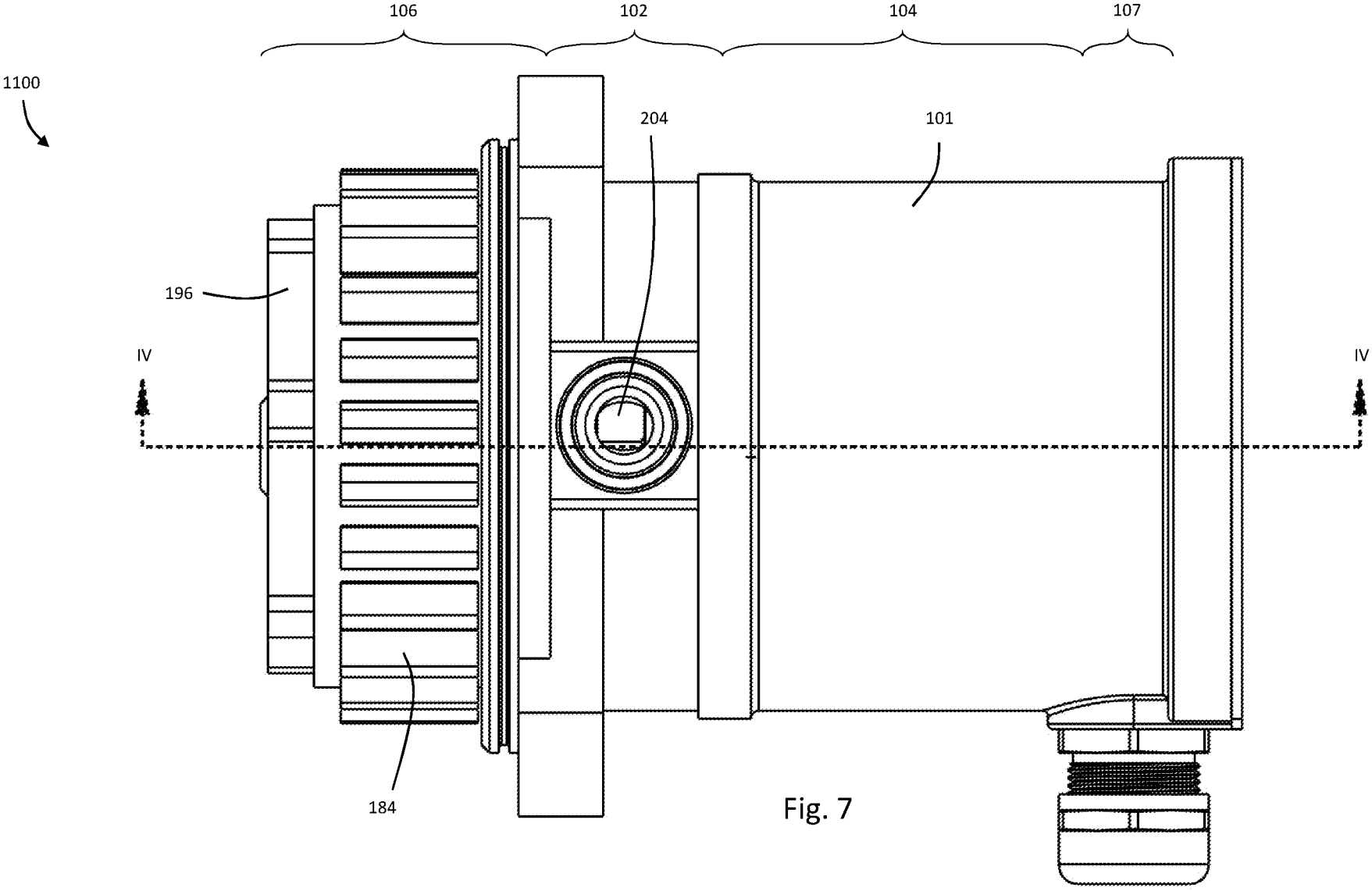
FIG. 7 is side view of a pump having a third drive system in accordance with the invention.
Figure 8:
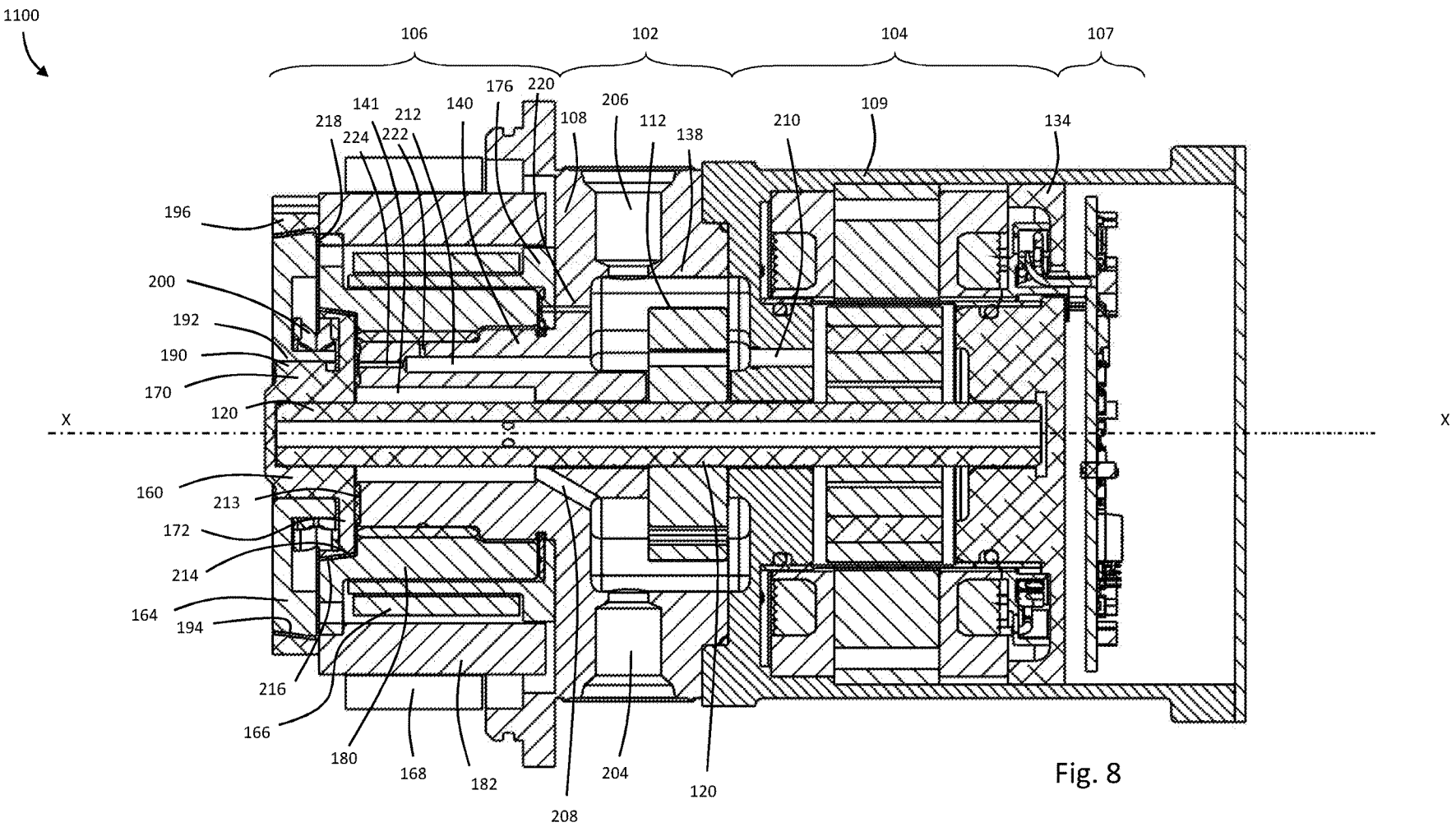
FIG. 8 is a side section view of the pump of FIG. 7 along line IV-IV; and, FIG. 9 is a detail view of a part of the pump of FIG. 7.
Figure 9:
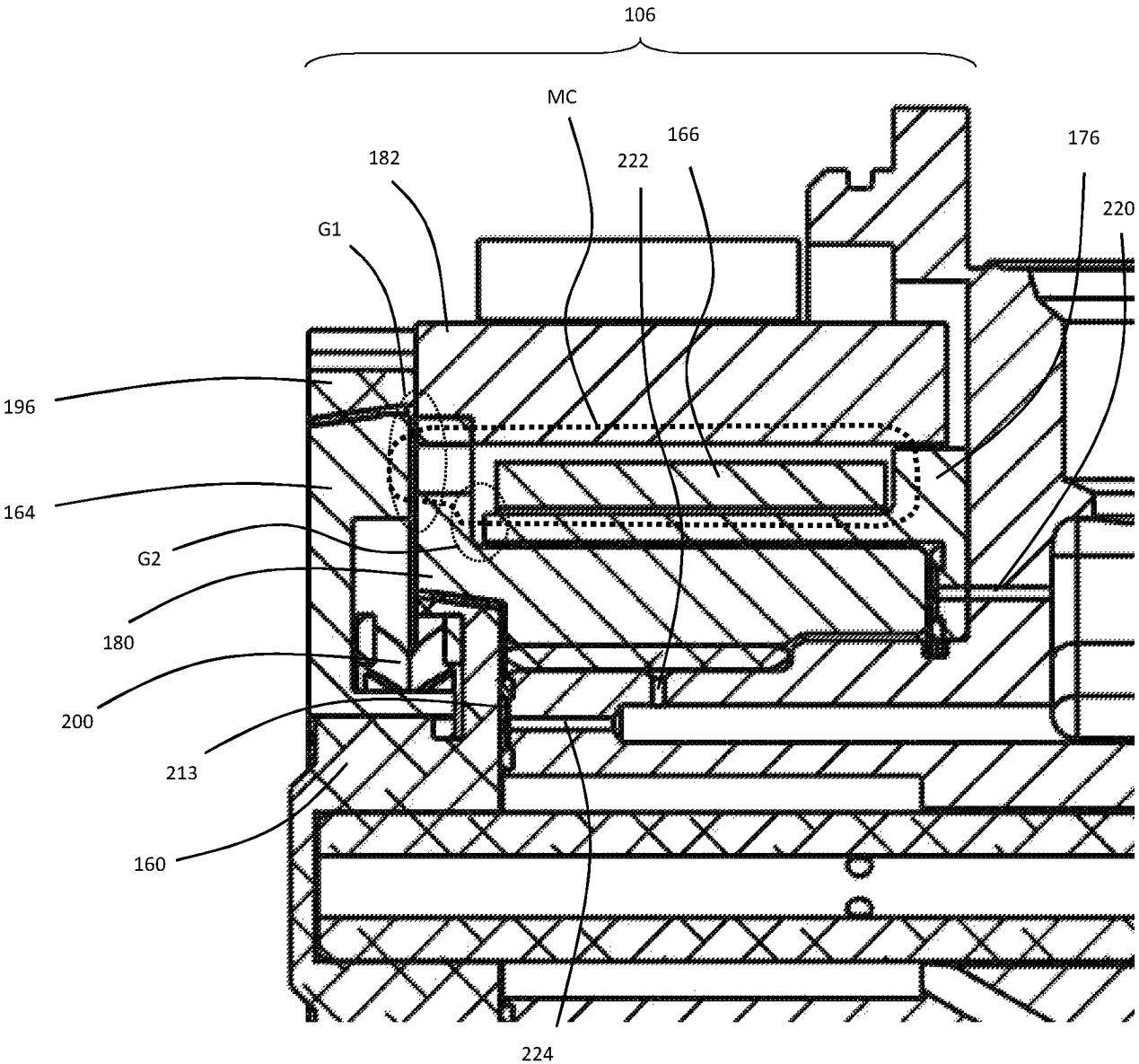

Referring to FIGS. 7 to 9, there is shown a pump assembly 1100 which is similar to the pump assemblies 100, 1000 and like reference numerals will be used to describe similar features.

As with the first embodiment 100, the pump assembly 1100 comprises a housing 101, a pump 102, an electric drive 104, a mechanical drive 106 and a control board 107. The pump assembly defines a main axis X.

The pump 102, electric drive 104 and control board 107 are physically identical to those in the first embodiment.

The housing 101 comprises a first housing part 108, a second housing part 109 and an end part 134. The first housing part 108 comprises a pump housing portion 138 defining a rotor cavity 112 eccentric with respect to the main axis X. The first housing part 108 further defines an annular first housing extension 140 projecting axially opposite to the rotor cavity 112. The first housing extension 140 comprises a central shaft bore 141. The first housing part 108 defines an oil inlet 204 and an oil outlet 206. The oil inlet 204 is configured to receive low pressure oil and to deliver it to both axial sides of the rotor cavity 112 at a first circumferential position. As well as being fed low pressure oil from the engine, the oil inlet is also in fluid communication with a return channel 208 in communication with the interior of the first housing extension 140.

The oil outlet 206 is configured to receive high pressure pumped oil from both axial sides of the rotor cavity at a second circumferential position, diametrically opposed to the first. As well as being connected to the engine, the oil outlet 206 is in fluid communication with the rotor of the electric drive 104 via an electric drive oil supply channel 210. The oil outlet 206 is also in fluid communication with a first mechanical drive oil supply channel 212 and a second mechanical drive oil supply channel 220. The first mechanical drive oil supply channel 212 splits into a radially extending sub-channel 222 which opens to the exterior circumferential surface of the shaft extension 140 and an axially extending sub-channel 224 which opens to the axial end of the shaft extension 140. The second mechanical drive oil supply channel 220 extends axially to an annular, axially facing surface of the solenoid mount 176.

The second housing part 109 and end part are similar to those of the first and second embodiments.

Turning to the mechanical drive 106, this operates in a similar manner to the mechanical drive of the second embodiment (i.e. utilises a cone clutch rather than the plate clutch of the first embodiment).

As will be described below, the mechanical drive 106 of the pump assembly 1100 has significantly reduced radial load. Therefore there is no need for a shaft bearing. The shaft seal 158 is also omitted as the mechanical drive is run "wet".

The mechanical drive 106 comprises a clutch plate boss 160, a clutch cone armature 164, a solenoid 166 and a spur gear 168.

The clutch plate boss 160 comprises a shaft portion 170 and a flange 172. The shaft portion 170 is keyed to the shaft 120 for rotation therewith. The shaft portion 170 defines an external spline 190 onto which the clutch cone armature 164 is mounted via a corresponding female spline 192. A fluid thrust bearing 213 is provided between the clutch plate boss 160 and the housing extension 140. The clutch cone armature 164 is therefore fixed for rotation with the boss 160 but can slide relative thereto along the axis X. The flange 172 extends radially outwardly from the shaft portion 170 and defines a tapered, male frustroconical clutch surface 214 on the radially outer position thereof. The frustroconical clutch surface 214 tapers radially inwardly moving axially towards the pump 102.

The clutch cone armature 164 is constructed from a ferrous material and defines an external conical friction surface 194 which tapers radially outwardly moving axially towards the pump 102. The clutch come armature further defines an annular abutment surface 218 facing the pump 104. The clutch cone is biased in an axial sense by a clutch spring 200. The clutch spring 200 is a compression spring which bears against the flange 172 of the clutch plate boss 160 and the clutch cone armature 164.

The solenoid 166 comprises a series of windings mounted on a solenoid mount 168, the solenoid mount being constructed from a ferromagnetic material.

The spur gear 168 comprises a gear inner 180, a gear outer 182 and a gear clutch collar 196. The gear inner 180 is similar to that of the first and second embodiments and is constructed from a ferromagnetic material. The gear inner 180 defines a tapered female frustroconical clutch surface 216. The gear outer 182 is attached to the gear inner 180 for rotation therewith and defines a series of gear teeth 184 (FIG. 7) configured to mesh with another gear (driven by a crankshaft). The gear outer 182 is constructed from a ferromagnetic material, and in conjunction with the solenoid mount 176 sandwiches the electromagnet therebetween. The spur gear 168 is capable of a small degree of movement (less than 1 mm) along the axis X.

The gear clutch collar 196 is an annular component which is attached to the gear outer 182 by mechanical fasteners 202. The collar 196 has a conical radially inner friction surface 198 which is configured to receive the external conical surface of the clutch cone armature 164. The clutch spring 200 biases the clutch cone armature into engagement with the gear clutch collar 196. The gear clutch collar 196 is specifically constructed from a material that is not (or is minimally) ferromagnetic.

A hydraulically lubricated bearing is formed between the radial outer surface of the first housing extension 140 and the inner surface of the gear inner 180. Oil is supplied via the radially extending sub-channel 222 of the first mechanical drive oil supply channel 212. Hydraulically lubricated fluid thrust bearings are formed as follows (FIG. 9): (i) a thrust bearing 213 is formed between the axial end of the first housing extension 140 and the clutch plate boss 160 and (ii) a thrust bearing 215 is formed between the solenoid mount 168 and the gear inner 180. Oil for the thrust bearing 213 is supplied via the axially extending sub-channel 224 of the first mechanical drive oil supply channel 212. Oil for the thrust bearing 215 is supplied via the second mechanical drive oil supply channel 220. The oil from these lubricated bearings returns to the low pressure oil inlet 204 via the shaft bore 141 and return channel 208. It will be noted that the electric drive lubrication and oil flow is the same as with the first and second embodiments.

A difference between the second and third embodiments is the provision of a secondary clutch (formed by surfaces 214, 216) between the clutch plate boss 160 and the gear inner 180. This clutch is oppositely oriented to the primary clutch between the clutch cone armature 164 and the collar 196.

The modes of operation of the pump assembly 1100 are the same as those of the pump assembly 1000. The differences in the modes of operation will be discussed below.

(i) Electric Only Mode

Referring to FIG. 9, the solenoid 166 is energised. It will be noted that the solenoid mount 168, gear inner 180, gear outer 182 and the clutch cone armature 164 are all constructed from a ferromagnetic material. The gear clutch collar 196 is constructed from a material which is not (or minimally) ferromagnetic.

The magnetic circuit MC created by the energised solenoid 166 is shown in FIG. 9. There are four clearance gaps between the various components which the circuit has to bridge, thus creating an electromagnetic force therebetween:

Gap 1: (G1) is a pair of annular axially extending gaps between the clutch cone armature 164 and the gear inner 180. This acts to draw the clutch cone armature 164 towards the gear inner 180.

Gap 2: (G2) is an annular axially extending gap between the solenoid mount 168 and the gear inner 180. This acts to draw the gear inner 180 towards the solenoid mount 176.

When the solenoid is energised, the attractive force felt by the clutch cone armature 164 is transferred to the clutch spring 200. This compresses and transfers load to the clutch plate boss 160. The motion of the clutch plate boss 160 is constrained against the thrust bearing 213. The attractive force on the gear inner 180 from gap G2 disengages the clutch formed between the gear inner 180 and the clutch plate boss 160. The gear inner 180 moves axially until it is constrained by the thrust bearing 215. In this state the thrust bearings 213, 215 carry the entire load produced by the solenoid 160. It will be noted that in this position, neither the clutch cone armature 164 nor the clutch plate boss 160 contacts the gear inner (although they are constantly being pulled in that direction as long as the solenoid is energised). In this way, both primary and secondary clutches are disengaged.

(ii) Mechanical Only Mode

In this mode, the solenoid is de-energised. The spring 200 separates the clutch cone armature 164 and the clutch plate boss 160. In doing so, the spring 200 forces both cones 194, 214 of the primary and secondary clutches respectively apart.

The clutch plate boss 160 is urged towards the pump. Movement of the clutch plate boss 160 is constrained by the thrust bearing 213. The spring 200 then urges the clutch cone armature 164 away from the pump. As the clutch cone armature 164 contacts the gear clutch collar 196 (engaging the primary clutch), the gear outer 182 (along with the gear inner 180) is pulled slightly away from the pump. This also facilitates engagement of the secondary clutch as the gear inner 180 is moved towards the now stationary clutch plate boss 160. This effectively creates a closed force loop maintained by the clutch spring 200. Once fully engaged, no further axial load is exerted on the thrust bearings 213, 215.

This engages both the primary and secondary clutches to form two drive paths between the gear 168 and the shaft 120.

(iii) Hybrid Mode

As above, both drives are engaged.

The ability to remove the rolling element bearings from the mechanical drive 106 is afforded as a result of using a gear transmission instead of a belt drive in the second and third embodiments.

Variations fall within the scope of the present invention.

Although the following embodiments relate to positive displacement oil pumps, it will be understood that the drive systems described herein can be applied to other types of pumps. For example, the technology may be applied to rotordynamic pumps, and/or coolant pumps.

The first and second embodiments have a sealed wet and dry side on the mechanical drive (separated by the dynamic shaft seal). In a further embodiment, the seal has been eliminated, where the entire mechanical drive is lubricated. The oil is allowed to leak into the transmission sump.

In further embodiments of the present invention, the mechanical drive, and more specifically the clutch could be used without the electrical drive. For example, in situations where the pump needed to be switched on and off by interrupting the mechanical drive, this could be achieved with the above-described clutch arrangement.

One such example could be a water pump which does not need to run continuously. The ability to deactivate the water pump would increase the efficiency of the vehicle.

Generally, as such pumps are not performance critical (like an oil pump), the failsafe provided by a cone clutch (FIG. 4 onwards) is not necessary, although may be implemented if desired.

What is claimed is:

1. A vehicle engine oil pump assembly comprising:

a pump subassembly having an inlet and an outlet;

an electrical drive arranged to selectively drive the pump subassembly;

a mechanical drive comprising a driven member configured to receive a drive torque from the vehicle engine;

a clutch in a load path between the driven member and the pump subassembly, the clutch being movable between a first condition in which the driven member drives the pump subassembly and a second condition in which the driven member can rotate freely relative to the pump subassembly;

wherein a lubrication flow path is provided such that at least one of the electrical drive and mechanical drive is at least partially lubricated by fluid from the outlet in use.

2. The vehicle engine oil pump assembly according to claim 1, in which both the electrical drive and mechanical drive are at least partially lubricated by fluid from the outlet in use.

3. The vehicle engine oil pump assembly according to claim 1, in which the electrical drive comprises a rotor and a stator, the rotor is supported on an electrical drive bearing, in which the lubrication flow path is provided from the outlet to the electrical drive bearing.

4. The vehicle engine oil pump assembly according to claim 3, in which the electrical drive bearing is a fluid bearing.

5. The vehicle engine oil pump assembly according to claim 3, in which there is provided a sealing structure between the stator and the rotor such that the stator is sealed from the pumped fluid in use.

6. The vehicle engine oil pump assembly according to claim 5, in which the sealing structure comprises a cylindrical structure spanning a radial gap between the stator and the rotor.

7. The vehicle engine oil pump assembly according to claim 3, in which the electric drive rotor is mounted on a common drive shaft with a rotor of the pump subassembly, and in which a return flow path for lubrication flow to the electric drive is provided through the common drive shaft.

8. The vehicle engine oil pump assembly according to claim 7, in which the return flow path for lubrication flow passes through the pump subassembly to the mechanical drive.

9. The vehicle engine oil pump assembly according to claim 8, in which the return flow path for lubrication flow returns to the inlet of the pump subassembly from the mechanical drive.

10. The vehicle engine oil pump assembly according to claim 7, in which the common drive shaft extends into the mechanical drive, and in which the lubrication flow from the electrical drive lubricates at least one mechanical drive bearing.

11. The vehicle engine oil pump assembly according to claim 1, comprising a housing, and a mechanical drive bearing between the housing and the driven member of the mechanical drive, in which the lubrication flow path provides fluid from the outlet to the mechanical drive bearing.

12. The vehicle engine oil pump assembly according to claim 10, in which the at least one mechanical drive bearing includes a fluid bearing.

13. The vehicle engine oil pump assembly according to claim 1, wherein the electrical drive and the mechanical drive are positioned on opposite sides of the pump subassembly.

14. The vehicle engine oil pump assembly according to claim 1, in which the pump subassembly comprises a positive displacement pump.

15. The vehicle engine oil pump assembly according to claim 14, in which the pump subassembly comprises a gerotor pump.

16. The vehicle engine oil pump assembly according to claim 1, in which the driven member comprises a pulley.

17. The vehicle engine oil pump assembly according to claim 1, in which the driven member comprises a gear formation.

18. A vehicle engine comprising a vehicle engine oil pump assembly according to claim 1.

19. A method of operation of a vehicle engine oil pump comprising the steps of:

providing a vehicle engine oil pump assembly according to claim 1;

providing a controller configured to selectively power the electrical drive and operate the clutch;

receiving an engine parameter with the controller; and using the controller to select mechanical and/or electrical power depending on the received engine parameter.

20. The method of operation of a vehicle engine oil pump according to claim 19, in which the controller is configured to select electrical power below a predetermined pumping demand, and electrical and mechanical power above the predetermined pumping demand.

* * * * *